US009900954B2

(12) United States Patent
Engelen et al.

(10) Patent No.: US 9,900,954 B2
(45) Date of Patent: Feb. 20, 2018

(54) LIGHTING CONTROL BASED ON ONE OR MORE LENGTHS OF FLEXIBLE SUBSTRATE

(71) Applicant: PHILIPS LIGHTING HOLDING B.V., Eindhoven (NL)

(72) Inventors: Dirk Valentinus René Engelen, Eindhoven (NL); Philip Steven Newton, Eindhoven (NL); Dzmitry Viktorovich Aliakseyeu, Eindhoven (NL); Tim Dekker, Eindhoven (NL); Ramon Antoine Wiro Clout, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/536,169

(22) PCT Filed: Dec. 10, 2015

(86) PCT No.: PCT/EP2015/079287

§ 371 (c)(1),
(2) Date: Jun. 15, 2017

(87) PCT Pub. No.: WO2016/096615

PCT Pub. Date: Jun. 23, 2016

(65) Prior Publication Data

US 2017/0359875 A1 Dec. 14, 2017

Related U.S. Application Data

(60) Provisional application No. 62/092,915, filed on Dec. 17, 2014.

(51) Int. Cl.
*H05B 33/08* (2006.01)

(52) U.S. Cl.
CPC ..... *H05B 33/0854* (2013.01); *H05B 33/0872* (2013.01)

(58) Field of Classification Search
CPC . H01L 33/005; B29C 65/5057; F21V 21/002; F21V 21/084; F21S 4/00;
(Continued)

(56) References Cited

U.S. PATENT DOCUMENTS 4,439,818 A 3/1984 Scheib
7,598,686 B2 10/2009 Lys et al.
(Continued)

FOREIGN PATENT DOCUMENTS

EP 2717653 A1 4/2014
WO WO2011151272 A1 12/2011

*Primary Examiner* — Jimmy Vu

(57) ABSTRACT

Illumination systems, flexible lighting apparatus and/or lighting control methods are described herein. In various embodiments, one or more signals indicative of a shape formed by a flexible substrate (104, 204, 304, 504, 604) of a flexible lighting apparatus (100, 200, 300, 600) may be obtained from a plurality of sensors (110, 210, 310) associated with the flexible lighting apparatus. One or more lengths of the flexible substrate along the one or more axes may be detected based on the one or more signals provided by the plurality of sensors. One or more LEDs (or more generally, light sources) (102, 202, 302, 502) disposed along the one or more axes of the flexible substrate may be energized to emit light having one or more lighting properties selected based on the detected one or more lengths.

15 Claims, 7 Drawing Sheets

(58) Field of Classification Search
CPC ..... H05B 33/08; H05B 33/0806; H05B 33/0854; H05B 33/0872
USPC .... 315/129–134, 185 R, 150–152, 291, 297, 315/307, 308, 312
See application file for complete search history.

(56) References Cited

U.S. PATENT DOCUMENTS

| | | | | |
|---|---|---|---|---|
| 8,262,250 | B2 | 9/2012 | Li et al. | |
| 9,271,343 | B2 * | 2/2016 | Mackool ..... | H05B 33/0803 |
| 2005/0162850 | A1 | 7/2005 | Luk et al. | |
| 2006/0219092 | A1 | 10/2006 | Mishima | |
| 2009/0147504 | A1 | 6/2009 | Teeters | |
| 2013/0249417 | A1 | 9/2013 | Verlinden | |
| 2014/0218924 | A1 | 8/2014 | Leland et al. | |
| 2014/0290824 | A1 | 10/2014 | Goldwater | |

* cited by examiner

LIGHTING CONTROL BASED ON ONE OR MORE LENGTHS OF FLEXIBLE SUBSTRATE

CROSS-REFERENCE TO PRIOR APPLICATIONS

This application is the U.S. National Phase application under 35 U.S.C. § 371 of International Application No. PCT/EP2015/079287 filed on Dec. 10, 2015, which claims the benefit of U.S. Patent Application No. 62/092,915, filed on Dec. 17, 2014. These applications are hereby incorporated by reference herein.

TECHNICAL FIELD

The present invention is directed generally to lighting control. More particularly, various inventive methods and apparatus disclosed herein relate to controlling light emitted by light sources on a flexible substrate based on one or more lengths of the flexible substrate along one or more axes.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Flexible lighting apparatus such as lighting tape, lighting strips or lighting ropes may include one or more light sources disposed on or within a flexible substrate. The flexible substrate may be stretched and/or cut, e.g., for artistic effect and/or for custom installation. Flexible lighting apparatus may be used to for various purposes, such as illuminating a ceiling recess, illuminating the perimeter of a picture frame or window, illuminating a walkway, illuminating the top of a cabinet, and so forth. It may be possible to independently control one or more properties of light emitted by one or more light sources of a flexible lighting apparatus using various mechanisms, such as by operating a portable computing device to communicate with a lighting system bridge. However, there is a need in the art to provide other means for independently controlling individual light sources, or groups of light sources, as well as for adaptively controlling light emission based on one or more lengths of the flexible substrate itself.

SUMMARY

The present disclosure is directed to inventive methods and apparatus for lighting control. For example, an illumination system may include a flexible substrate with a plurality of integral light sources, as well as a controller. The light sources may be, for instance, LEDs. The flexible substrate may take various shapes, such as elongate, square, rectangular, circular, elliptical, and so forth. A plurality of sensors may be provided, e.g., integral, and in some cases coextensive, with the light sources. The sensors may provide signals that are analyzed by the controller to make one or more observations about a shape of the flexible substrate, particularly a length of the flexible substrate along various axes that may be altered as a result of, for instance, stretching, tearing, or cutting. The controller may then selectively energize some or all of the light sources in various ways (e.g., alter a gradient, increase/decrease intensity, etc.) in response to the observations about the flexible substrate's shape.

Generally, in one aspect, an illumination system may include: a flexible substrate; a plurality of light-emitting diodes ("LEDs") disposed along one or more axes of the flexible substrate; a plurality of sensors configured to provide one or more signals indicative of a shape formed by the flexible strip; and a controller communicably coupled with the plurality of LEDs and the plurality of sensors. The controller may be configured to: detect one or more lengths of the flexible substrate along the one or more axes based on the one or more signals provided by the plurality of sensors; and energize one or more LEDs of the plurality of LEDs to emit light having one or more lighting properties selected based on the detected one or more lengths.

In various embodiments, the controller may be configured to detect that the flexible substrate has been stretched based on a change in resistance detected at one or more of the plurality of sensors. In various versions, the controller may be further configured to calculate a distance between two or more of the plurality of LEDs based on the detected change in resistance, and to select the one or more lighting properties based on the calculated distance between the two or more of the plurality of LEDs. In various versions, the controller may be further configured to select an intensity of light emitted by one or more of the two or more of the plurality of LEDs based on the calculated distance.

In various embodiments, the plurality of sensors may include a plurality of strain gauges. In various embodiments, the controller may be configured to determine that the flexible substrate has been severed across an axis based on the one or more signals provided by the plurality of sensors. In various versions, the controller may be configured to determine that the flexible substrate has been severed across the axis based on detection that a resistance associated with one or more sensors has increased above a predetermined threshold.

In various embodiments, the plurality of LEDs and the plurality of sensors may be spatially coextensive. In various versions, the controller may be configured to identify a terminal LED along a particular axis of the flexible substrate based on the one or more signals provided by the plurality of sensors. In various versions, the controller may be configured to identify the terminal LED along the particular axis of the flexible substrate based on an amount of current detected through one or more of a plurality of LEDs disposed along the particular axis. In various versions, the controller may be configured to identify the terminal LED along the axis of the flexible substrate based on detected alteration of a control packet passed along one or more of the plurality of sensors or plurality of LEDs disposed along the particular axis.

In another aspect, a computer-implemented method may include: obtaining, from a plurality of sensors associated with a flexible lighting apparatus, one or more signals indicative of a shape formed by a flexible substrate of the flexible lighting apparatus; detecting, based on the one or more signals provided by the plurality of sensors, one or more lengths of the flexible substrate along one or more axes; and energizing one or more LEDs of a plurality of LEDs disposed along the one or more axes of the flexible substrate to emit light having one or more lighting properties selected based on the detected one or more lengths.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g., for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

As used herein, a "flexible substrate" may refer to a material on or in which one or more light sources (e.g., LED, incandescent, halogen, etc.) may be integrated to form a flexible lighting apparatus. In addition to the light sources, various circuitry utilized for operating the light sources, such as wiring, control circuitry (e.g., one or more controllers), power circuitry, and so forth, may be integrated on or within flexible substrate. Flexible substrates may take various nominal shapes, including but not limited to elongate, square, rectangular, circular, elliptical, and so forth. Flexible substrates may be marketed in various forms, such as light strips, light tape (e.g., if one or more surfaces include adhesives), light ropes, or even light strings. In other instances, a flexible substrate may appear similar to a textile (and may be referred to as such), and may be used as, for instance, a lighting curtain or a lighting blanket. Flexible substrates may be constructed in various ways, including but not limited to weaving or molding. A flexible substrate may be capable of being formed into various shapes. Accordingly, a flexible substrate may be constructed from various combinations of a variety of materials, including but not limited to plastics such as polymer silicone, nylon, rubber, cloth, and so forth.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Flexible lighting apparatus such as lighting tape, lighting strips or lighting ropes may include one or more light sources disposed on or within a flexible substrate. The flexible substrate may be stretched and/or cut, e.g., for artistic effect and/or for custom installation. While independent control of one or more properties of light emitted by one or more light sources of a flexible lighting apparatus may be possible, there is a need in the art to provide other means for lighting control, as well as for adaptively controlling light emission based on a shape of the flexible substrate itself. In view of the foregoing, various embodiments and implementations of the present invention are directed to a flexible lighting apparatus that includes one or more sensors that provide signals indicative of a shape of a flexible substrate of the flexible lighting apparatus, and a controller that is configured to select one or more properties of light emitted by a plurality of light sources of the flexible lighting apparatus based on the one or more signals provided by the sensors.

Figure 1:
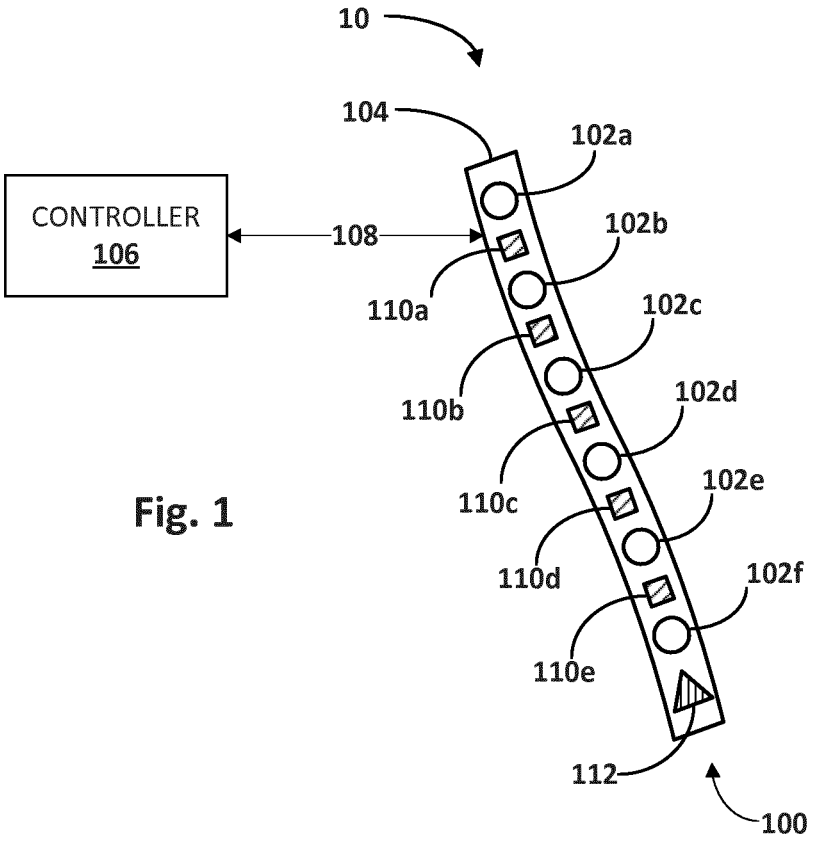
FIG. 1 illustrates an example illumination system, in accordance with various embodiments.

Referring to FIG. 1, in one embodiment, an illumination system 10 may include a flexible lighting apparatus 100, which itself may include a plurality of light sources 102*a-f* (referred to generically as "light sources 102") disposed on or within a flexible substrate 104. In this example, flexible substrate 104 is nominally shaped as an elongate strip, but as noted above, other nominal shapes are contemplated. Light sources 102 may come in various forms, such as LED, incandescent, halogen, fluorescent, and so forth. In some embodiments, more than one type of light source may be employed on a single flexible substrate 104. In various embodiments, one or more properties of light emitted by light sources 102, such as hue, saturation, brightness, intensity, color temperature, etc., may be controllable. Flexible substrate 104 may have various dimensions, and various numbers of light sources 102 may be secured along those dimensions at various intervals and/or densities, on one or more surfaces, or even within flexible substrate.

Light sources 102 may be communicably coupled with a controller 106 via one or more communication links 108. In some embodiments, controller 106 may be integral with flexible substrate 104, in which case communication link 108 may take the form of one or more buses (e.g., $I^2C$), wires, conductors, or other transmission means that may be found, for instance, on a printed circuit board. In other embodiments, controller 106 may be separate from flexible substrate 104. In such embodiments, communication link 108 may take the form of a wireless or wired communication link that employs various communication technologies, such as WiFi, BlueTooth, near field communication ("NFC"), Ethernet, coded light, or ad hoc communication technologies such as ZigBee.

Controller 106 may also be communicably coupled with a plurality of sensors 110*a-e* (referred to generically as "sensors 110"). Sensors 110 may be configured to provide one or more signals indicative of a shape formed by flexible substrate 104. Based on these signals, in various embodiments, controller 106 may make one or more determinations about one or more lengths of flexible substrate 104 along various axes. Based on these length determinations, controller 106 may energize light sources 102 to emit light having various selected lighting properties (e.g., hue, saturation, intensity, gradient, dynamic lighting effects, etc.).

For example, in some embodiments, a degree of a stretch along a first axis (e.g., a longitudinal axis of flexible lighting apparatus 100 in FIG. 1) may dictate an intensity (or a degree of another lighting property) of light emitted by one or more light sources 102. As another example, controller 106 may determine that flexible substrate 104 has been torn or otherwise severed so that one or more light sources 102 have been trimmed from the end. For example, controller 106 may utilize various techniques described below to identify a terminal light source 102 (e.g., the last light source 102 before a tear) along a particular axis of flexible substrate 104 based on the one or more signals provided by the plurality of sensors. Controller 106 may select one or more properties of light emitted by one or more light sources 102 based on identification of the terminal light source 102, the location of the tear, and/or a remaining length of flexible substrate 104 post-tear.

In some embodiments, an orientation sensor 112 may be configured to provide signals indicative of an orientation of flexible substrate 104, e.g., relative to gravity or magnetic north. In some embodiments, orientation sensor 112 may include an accelerometer and/or a compass. In some embodiments, controller 106 may be configured to determine, based on the signal provided by orientation sensor 112, that a stretch in flexible substrate 104 is at least partially attributable to gravity (e.g., as would occur to a portion of flexible substrate 104 that is draped over a top corner of a rectangular picture frame). In some embodiments, orientation sensor 112 may include a gyroscope that provides a signal that can be used by controller 106 to determine, for example, a yaw of flexible substrate 104. In some embodiments, a signal from both an accelerometer and a gyroscope may be combined, e.g., using a Kalman filter, to determine the yaw.

Sensors 110 may be implemented in various ways. In some embodiments, sensors 110 may be implemented using one or more strain gauges. In some embodiments, sensors 110 may be positioned between light sources 102. In some embodiments, sensors 110 may be coextensive with light sources 102. For example, in some embodiments, each light source 102 may be an "intelligent" LED that includes logic (e.g., any combination of hardware or software executable by one or more processors) configured to detect one or more aspects of a shape of flexible substrate 104. As another example, in some embodiments, a light source 102 and an adjacent sensor 110 may collectively be considered a "node," and operation of the light source may be tied directly to a state of the corresponding sensor 110.

Figure 2:
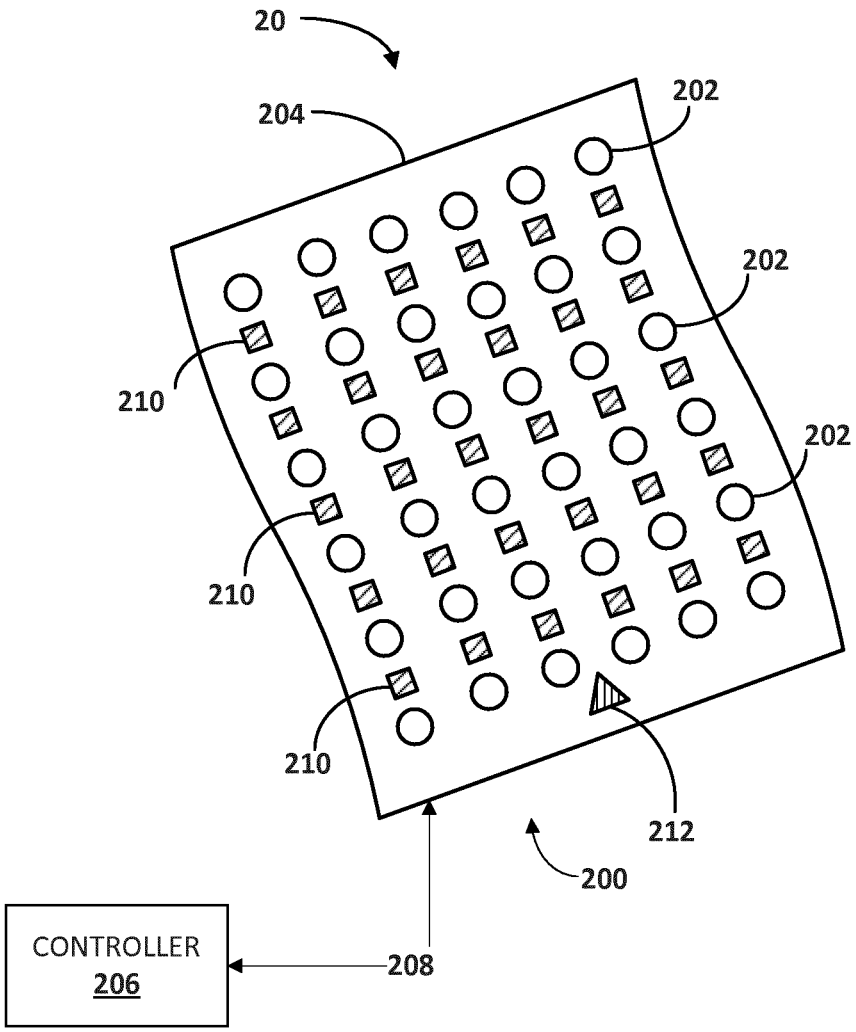
FIG. 2 illustrates another example illumination system, in accordance with various embodiments.

FIG. 2 depicts another illumination system 20. Similar to flexible lighting apparatus 100 of FIG. 1, a flexible lighting apparatus 200 may include a plurality of light sources 202 (only some of the light sources are labeled for simplicity's sake) disposed on or within a flexible substrate 204. Light sources 202 may be communicably coupled with a controller 206, e.g., via communication path 208. Controller 206 may also be communicable coupled with a plurality of sensors 210 (only some of the sensors are labeled for simplicity's sake). In this example, flexible substrate 204 is rectangular, rather than elongate like flexible substrate 104 in FIG. 1. Accordingly, rather than light sources/sensors being disposed along a single axis, a two-dimensional array of light sources 202 and sensors 210 is provided. Based on signals from sensors 210, controller 206 may be configured to detect one or more lengths of flexible substrate 204 along a plurality of axes in either of the two dimensions, as well as a change in those one or more lengths due to, for instance, stretching or tearing. Illumination system 20 also includes an orientation sensor 212 that may operate and/or include similar components as orientation sensor 112 of FIG. 1.

While FIGS. 1 and 2 demonstrate the capability to determine lengths in one and two dimensions, respectively, this is not meant to be limiting. In some embodiments where sensors are distributed within a flexible substrate in three-dimensions, one or more lengths of a flexible substrate due to stretching or tearing may be determined along an axis for any of those dimensions. Additionally, while stretching (i.e., increasing flexible substrate length) is described repeatedly herein, disclosed techniques for determining lengths may be equally applicable to instances where a length of a flexible substrate along a particular axis is decreased, e.g., due to smashing or squeezing (in which case one or more light sources may end up closer together).

Figure 3:
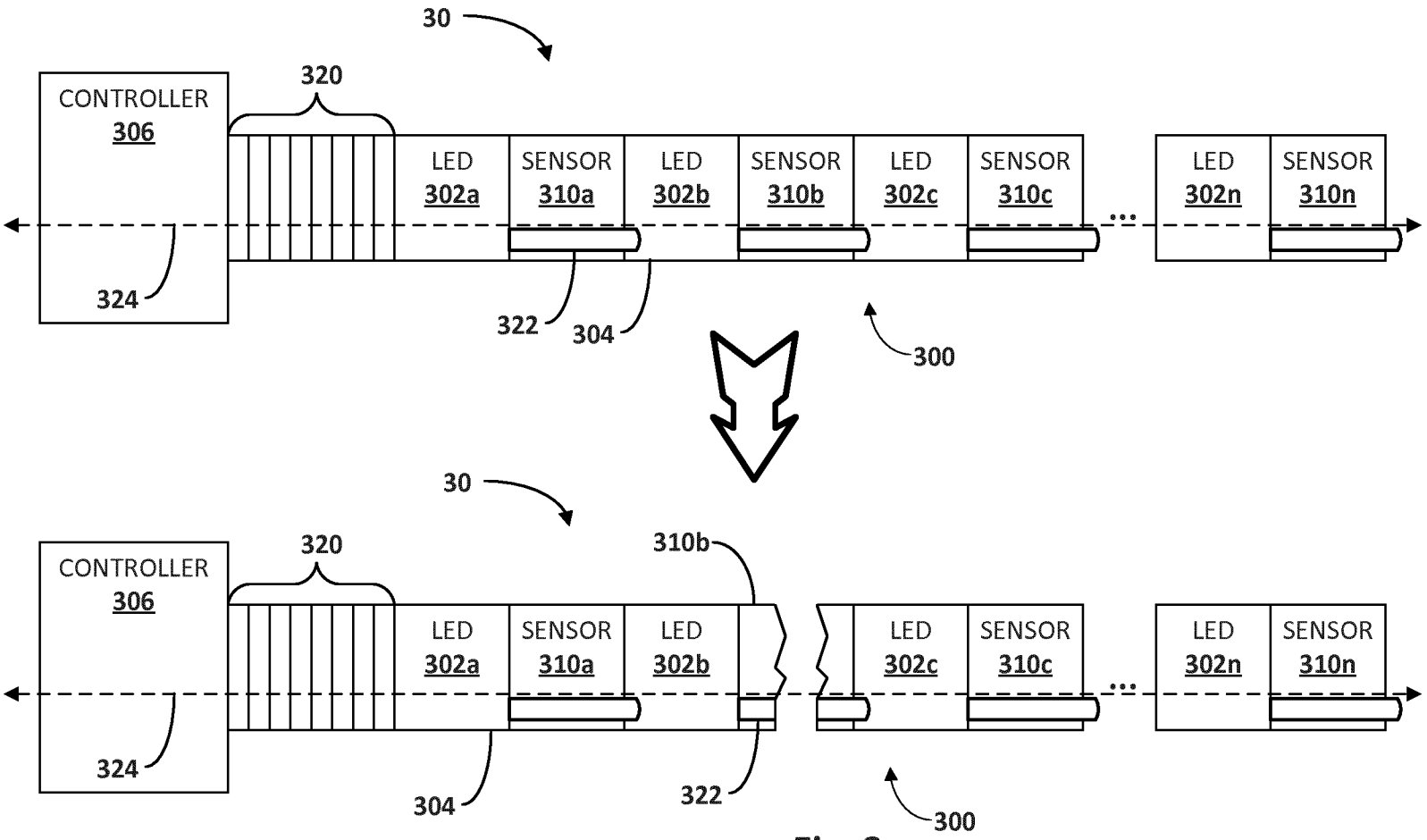
FIG. 3 schematically illustrates another example illumination system, in accordance with various embodiments.

FIG. 3 depicts schematically and in greater detail than FIGS. 1 and 2 example components that may be included in an illumination system 30, which may be similar to illumination systems 10 and 20, that is configured with selected aspects of the present disclosure. At the top of FIG. 3 is a flexible lighting apparatus 300 that includes a controller 306 communicably coupled with a plurality of LEDs 302*a*-302*n* and a plurality of sensors 310*a*-310*n*. In this example, LEDs 302 and sensors 310 are part of a roll 320, with those LEDs 302 and sensors 310 that have already been "unrolled" being visible. In some embodiments, the LED 302 nearest roll 320 may be considered the "first" (or "last," depending on the nomenclature used) LED 302, and the terminal LED may be the "reachable" LED (e.g., that has not been severed) that is furthest from the "first" LED. At the top of FIG. 3, for instance, LED 302*a* may be considered the first "reachable" LED and LED 302*n* may be considered the "terminal" LED. Each sensor 310 in FIG. 3 takes the form of a strain gauge 322, but other types of sensors that incorporate resistive paths may be employed. A strain gauge 322 may include a resistive path that has a nominal known resistance, $R_{normal}$.

In various embodiments, controller 306 may be configured to determine that flexible substrate 304 has been severed across an axis 324 based on one or more signals provided by plurality of sensors 310. For instance, at the bottom of FIG. 3, flexible lighting apparatus 300 is has been cut or severed at the location of sensor 310*b*. This also cuts or severs the corresponding strain gauge 322, thus severing the resistive path at that location. In various embodiments, controller 306 may be configured to determine that flexible substrate 304 has been severed across axis 324 based on detection that a resistance associated with one or more sensors, e.g., sensor 310*b* in this example, has increased above a predetermined threshold. The predetermined threshold of resistance may be selected as a very high value that may approach infinity. For example, the threshold may be selected so that noise created by passage of a trivial number of electrons across the tear or severance (e.g., through a medium such as air or water) would effectively be ignored by controller 106 as insufficient to constitute an intact resistive path.

As noted above, in various embodiments, controller 306 (or 106 or 206) may be configured to identify a terminal LED 302 along axis 324 of flexible substrate 304 based on one or more signals provided by plurality of sensors 310. This may be accomplished in various ways. In some embodiments, controller 306 may be configured to identify the terminal LED—e.g., which at the bottom of FIG. 3 is now 302*b*—along axis 324 of flexible substrate 304 based on an amount of current detected through one or more of plurality of LEDs 302 disposed along axis 324. For example, controller may energize LEDs 302 one at a time, one after another, starting at LED 302*a*. In each instance, current may pass from controller 306 (which may channel power from a power source (not depicted) such as a battery or mains) through the respective LED. However, due to the tear, controller 306 attempts to energize LED 302*c* (and any subsequent LED), no current may flow, which may indicate that that LED 302 is no longer "reachable." Additionally or alternatively, LEDs 302 may be energized progressively, so that as each LED 302 is added the total current increases. When an attempt is made to energize another LED 302 but the total current does not increase, controller 306 may determine that the last LED 302 successfully energized is the terminal LED.

Figure 4:
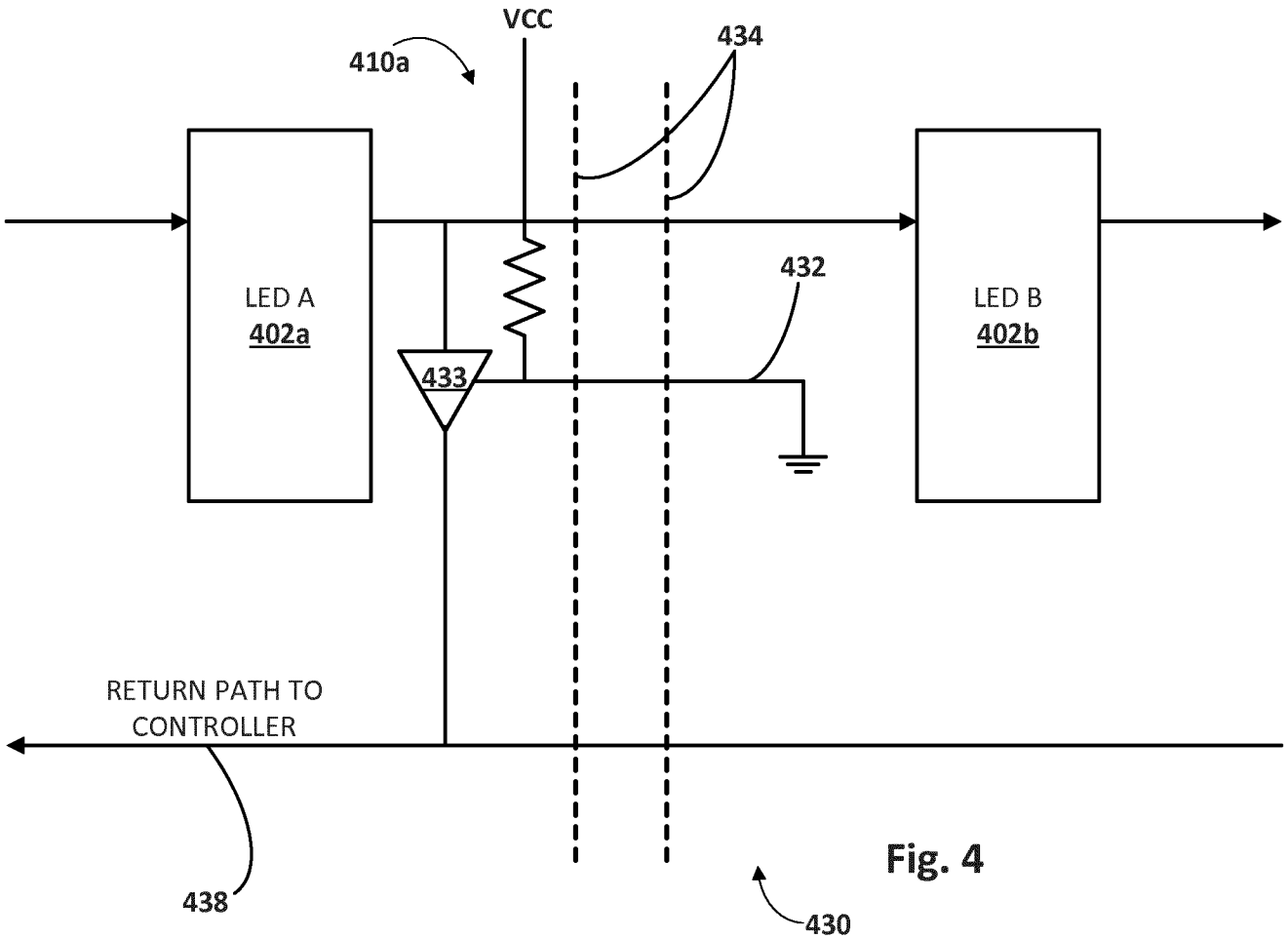
FIG. 4 depicts a light source and sensor paired as an intelligent node, in accordance with various embodiments.

FIG. 4 depicts one example of how a light source 402*a* and sensor circuitry 410*a* may collectively form a node 430. Sensor circuitry 410*a* (which may be repeated at every node) may include a voltage controlled switch 433. Creation of a tear 434 may sever a wire 432 that controls the gate of switch 433. This in turn may pull a gate voltage of switch 433 high, closing a control output of LED A 402*a* to the return path. Control packets may then pass through a return path 438 back to a controller (not depicted in FIG. 4). Based on an amount of control packets received via return path 438, the controller may determine the existence of tear 434, and may act accordingly (e.g., by identifying a new terminal LED 402*a*).

Referring back to FIG. 3, in some embodiments, controller 306 (or an individual intelligent node) may detect an alteration of control data passed along sensors 310, LEDs 302, and/or nodes (generically referred to as an "LED/sensor/node") disposed along axis 324. In some such embodiments, each LED/sensor/node may have built in "intelligence" (e.g., microcontroller, circuitry, etc.) configured to alter control data received from a previous LED/sensor/node (e.g., one step closer to controller 306), e.g., by adding an identifier associated with the LED/sensor/node, removing one or more packets or bytes from the control data, etc. The LED/sensor/node may then pass the altered control data onto a subsequent LED/sensor/node (e.g., one step further from controller 306).

In the event of a tear, the last LED/sensor/node to receive the control data may alter it and then return the altered control data to controller 306 (e.g., along return path 438). Controller 306 may then determine which LED/sensor/node is the last one that is reachable, and/or determine how many LEDs/sensors/nodes are reachable, based on the detected alteration (e.g., a "fingerprint" of the last LED/sensor/node, or a count of packets remaining in the control data), and may classify that LED/sensor/node as "terminal." In some embodiments wherein each LED/sensor/node removes a portion (e.g., one or more bytes, a packet) of the control data, controller 306 may adapt to a new number N of reachable nodes (e.g., remaining after a tear) by transmitting out control data with N+1 portions and, for instance, expecting control data with one portion back. If no control data is returned, controller 306 may increase the amount of data portions it transmits until something is received in return.

In various embodiments, a controller (e.g., 106, 206, 306) may be configured to determine a distance d between two or more (e.g., neighboring) light sources (e.g., 102, 202, 302) based on one or more signals provided a plurality of sensors (e.g., 110, 210, 310). For example, in some embodiments, change in resistance from a nominal known resistance, $R_{meas}-R_{normal}$, may be detected by a controller. The controller may determine based on the detected change that the flexible substrate has been stretched at a particular location. The controller may then select one or more lighting properties to be emitted by one or more light sources based on the calculated distance between the two or more of the plurality of light sources and/or the determined location of the stretch. For example, the controller may increase an intensity of light emitted by one or more LEDs based on the calculated distance d and location, e.g., to make up for the LEDs being spread further apart due to a stretch.

In some embodiments, intelligent nodes (e.g., a light source/sensor pair described above) may be configured to report various locally-sensed values, such as resistance, back to a controller. For example, suppose each node reports back to the controller with a resistance value measured at the sensor of the node. The controller may then have at its disposal a number N ($N \in \mathbb{Z}^*$) of nodes that are reachable and a set of N−1 resistance values, $R_{meas}[N-1]$. Using this information, in some embodiments, the controller may calculate a distance d[x] between nodes x and x+1 using a formula such as the following:

$$d[x] = \text{distance}_{normal} \times \frac{R_{meas}[x]}{R_{normal}} \tag{1}$$

In various embodiments, the controller may also calculate a total length L of the flexible substrate along the particular axis under examination by using a formula such as the following:

$$L = \Sigma_{x=1}^{x=N-1} d[x] \tag{2}$$

One or more of these various pieces of information may be usable by a controller, alone or in combination, to select various properties of light to be emitted by one or more light sources. For example, in some embodiments, the controller may select a gradient of a particular lighting property (e.g., color, saturation, brightness) that is to be collectively emitted by a plurality of light sources along a particular axis. If an overall length L of a flexible substrate along a particular axis is increased due to stretching but the number of reachable nodes is decreased due to tearing, the controller may cause the remaining nodes to collectively render a gradient of a particular lighting property differently than if, say, the overall length L of the flexible substrate is not increased from a nominal length and no nodes are removed by tearing.

Figure 5A:
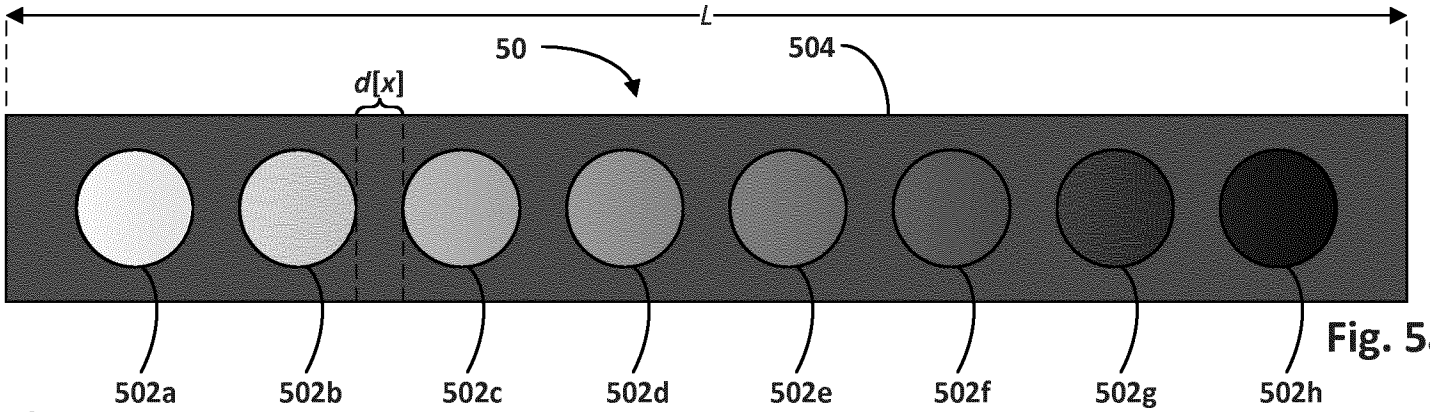
FIG. 5 depicts examples of how a gradient rendered by a plurality of light sources of a flexible lighting apparatus may be affected by stretching or tearing, in accordance with various embodiments.
Figure 5B:
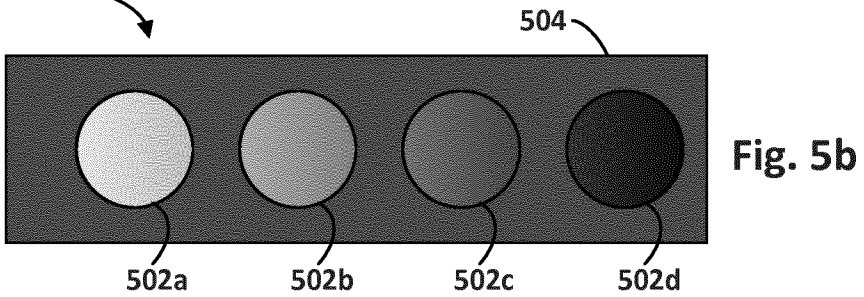
Figure 5C:
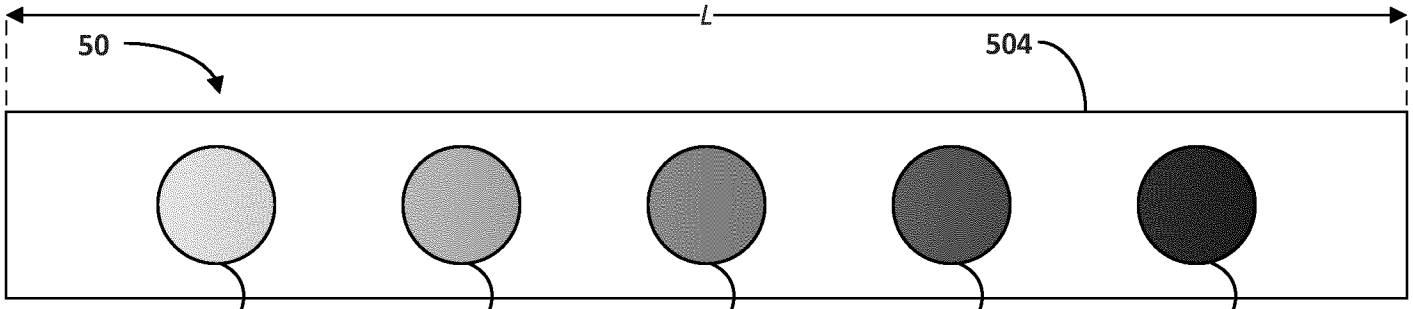

Examples of how lighting may be effected by a distance d[x] between nodes, an overall length L of a flexible substrate along a particular axis, and/or a location of a tear (and hence, a terminal light source), are depicted in FIGS. 5*a-c*. An illumination system 50 includes a flexible lighting apparatus 500, which may include the same components that were depicted in FIGS. 1-3, and therefore those components are in large part unlabeled for the sake of brevity. In FIG. 5*a*, a flexible substrate 504 is depicted in its nominal shape (i.e., unstretched, untorn). A plurality of LEDs 502*a-h* are depicted, each emitting light having a particular level of a particular lighting property (e.g., color, brightness, saturation, etc.), such that the plurality of LEDs 502*a-h* collectively emit a gradient. In FIG. 5*b*, flexible substrate 504 has been cut or torn between LEDs 502*d* and 502*e*. This leaves LEDs 502*a-d* to render the entire gradient, which means there are less intermediate steps of the gradient rendered. In FIG. 5*c*, flexible substrate 504 has been cut or torn after LED 502*e*, and then stretched back to its original length L. That leaves five LEDs, 502*a*-502*e*, to render the entire gradient.

In some embodiments, a flexible lighting apparatus may be stretched in a non-uniform manner. For instance, a portion of a flexible substrate may be glued to a surface during installation, and then an adjacent portion may be stretched to accommodate further installation. A controller (e.g., 106, 206, 306) may be configured to take this non-uniformity in d[x] values into account. Suppose a first portion of a flexible substrate is stretched along a particular axis to a greater extent than a second portion. Without any adjustment, the intensity at the first portion may be perceived as lower simply because the light sources will be further apart. In various embodiments, the controller may increase intensity in the first portion to compensate for this effect. More generally, in various embodiments, a controller may energize one or more light source of a plurality of light sources to emit light having an amount of a particular lighting property (e.g., intensity, saturation, a particular hue, etc.) that is proportional to a distance between one or more neighboring light sources.

In some embodiments, in addition to or instead of a central controller compensating emitted light, nodes (i.e., light source/sensor pairs) themselves may compensate one or more properties of light they emit based on a stretch sensed nearby in a flexible substrate. For example, a node may include circuitry to adjust a pulse width modulated ("PWM") signal provided to the node's light source based on a detected resistance. Various timing mechanisms, such as a 555 timer integrated chip ("IC"), may be employed to generate the PWM signal at a duty cycle that varies based on a voltage across a strain gauge and/or a current buffer. If the resistance sensed at the strain gauge increases, a charge time of one or more capacitors in the 555 timer IC may increase, which in turn may increase the duty cycle of the PWM signal. Increasing the duty cycle may, in some embodiments, cause a corresponding increase in light output of the node's light source. In some embodiments, this increase in light output may compensate for an increase in space between light sources of the flexible lighting apparatus due to the detected stretch. In other embodiments, each node may transmit an indication of a resistance sensed in a strain gauge to a controller (e.g., 106, 206, 306), e.g., using an $I^2C$ bus, and the controller may adjust light output by the node's light source accordingly.

Figure 6:
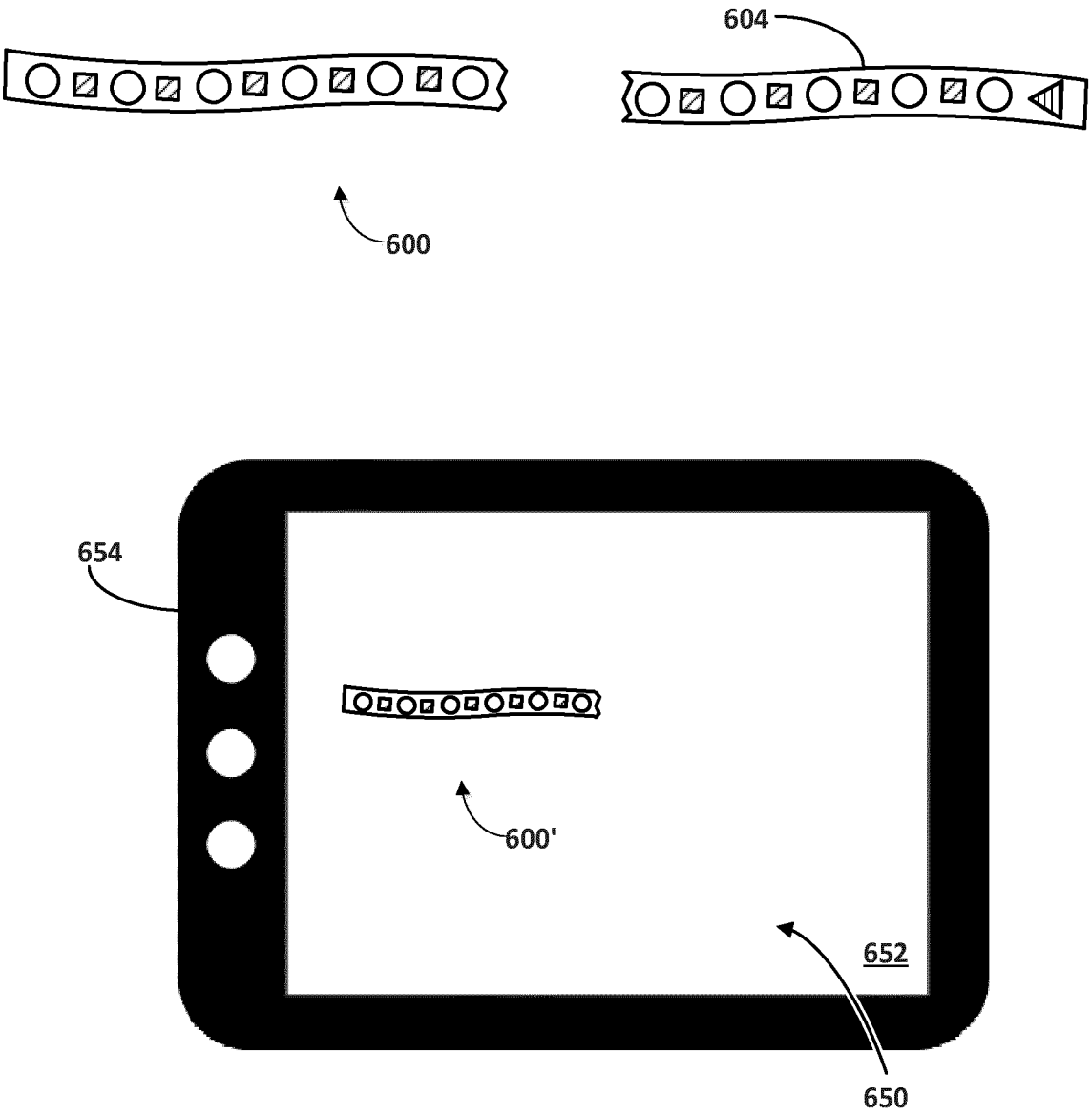
FIG. 6 depicts an example user interface, in accordance with various embodiments

FIG. 6 depicts another aspect of the present disclosure. A user interface 650 may be rendered on a display 652 of a computing device 654 to facilitate user control of a nearby flexible lighting apparatus 600 configured with selected aspects of the present disclosure. For the sake of clarity and brevity, many components of flexible lighting apparatus 600 that are similar to components of other embodiments describe herein are not labeled. In various embodiments, computing device 654 may come in various forms, including but not limited to a smart phone, tablet computer, wearable computing device (e.g., smart watch, smart glasses), a laptop computer, a desktop computer, a set top box, and so forth. Display 652 may take various forms as well, such as a touch screen display or a separate display.

In this example, flexible substrate 604 of flexible lighting apparatus 600 has been severed as shown. A controller (not depicted in FIG. 6) associated with flexible lighting apparatus 600 (e.g., communicably coupled with one or more light sources and/or sensors of flexible lighting apparatus 600) may detect this severance, e.g., using one or more methods described above. In response, the controller may provide computing device 654 with data that computing device 654 may use to render interface 650. Interface 650 may include a depiction 600' of a remaining portion flexible lighting control apparatus.

In various embodiments, a user may operate interface 650 to generate one or more lighting control commands to control one or more properties of light emitted by one or more light sources of flexible lighting apparatus 600. Those lighting control commands may be transmitted to the controller of flexible lighting apparatus 600, e.g., using various wired or wireless techniques such as WiFi, BlueTooth, ZigBee, coded light, and so forth. In some embodiments, instead of transmitting lighting control commands directly to flexible lighting apparatus 600, computing device 654 may transmit lighting control commands to a lighting system bridge (not shown). The lighting system bridge may be configured to cause one or more light sources of flexible lighting apparatus 600 to emit light having the user-selected properties.

In various embodiments, a user may be able to operate user interface 650 to select a lighting property for which a gradient will be rendered by the remaining uncut portion of flexible lighting apparatus 600 (e.g., the portion on the left). For example, in some embodiments, a user may select from a color gradient (e.g., a rainbow), a brightness gradient, a saturation gradient, and so forth. The user may also be able to select lighting property values at one or both extremes of the rendered gradient. For example, a user may operate interface 650 to cause a gradient of colors rendered by a plurality of light sources of a remaining portion of flexible lighting apparatus 600 to extend between red and green, instead of all the way across the rainbow from red to violet.

In various embodiments, user interface 650 may be rendered to depict one or more stretches in flexible lighting apparatus 600 as well. For example, the controller may provide data described above (e.g., distance d[x] between light sources x and x+1, total length L of a flexible substrate along a particular axis, etc.) to computing device 654. Computing device 654 may then use this data to render flexible lighting apparatus 600 to includes stretches. A user may then operate depictions of individual light sources or groups of light sources to, e.g., manually compensate for an increase in distance between two or more light sources caused by a stretch.

A controller (e.g., 106, 206, 306) may determine the various data points described herein (e.g., d[x] between light sources, total length L of a flexible substrate along a particular axis, location of one or more tears, identity of a terminal node/light source/sensor, etc.) at various points in time. In some embodiments, signals may be obtained from sensors (e.g., 110, 210, 310) during or after a power up of a flexible lighting apparatus. In some embodiments, signals may be obtained from sensors periodically (e.g., every few seconds, every few milliseconds), or even continuously. In the latter cases, one or more properties of light emitted by light sources of the flexible lighting apparatus may be periodically or continuously altered. In some embodiments, signals may be obtained from sensors at the behest of a user.

Figure 7:
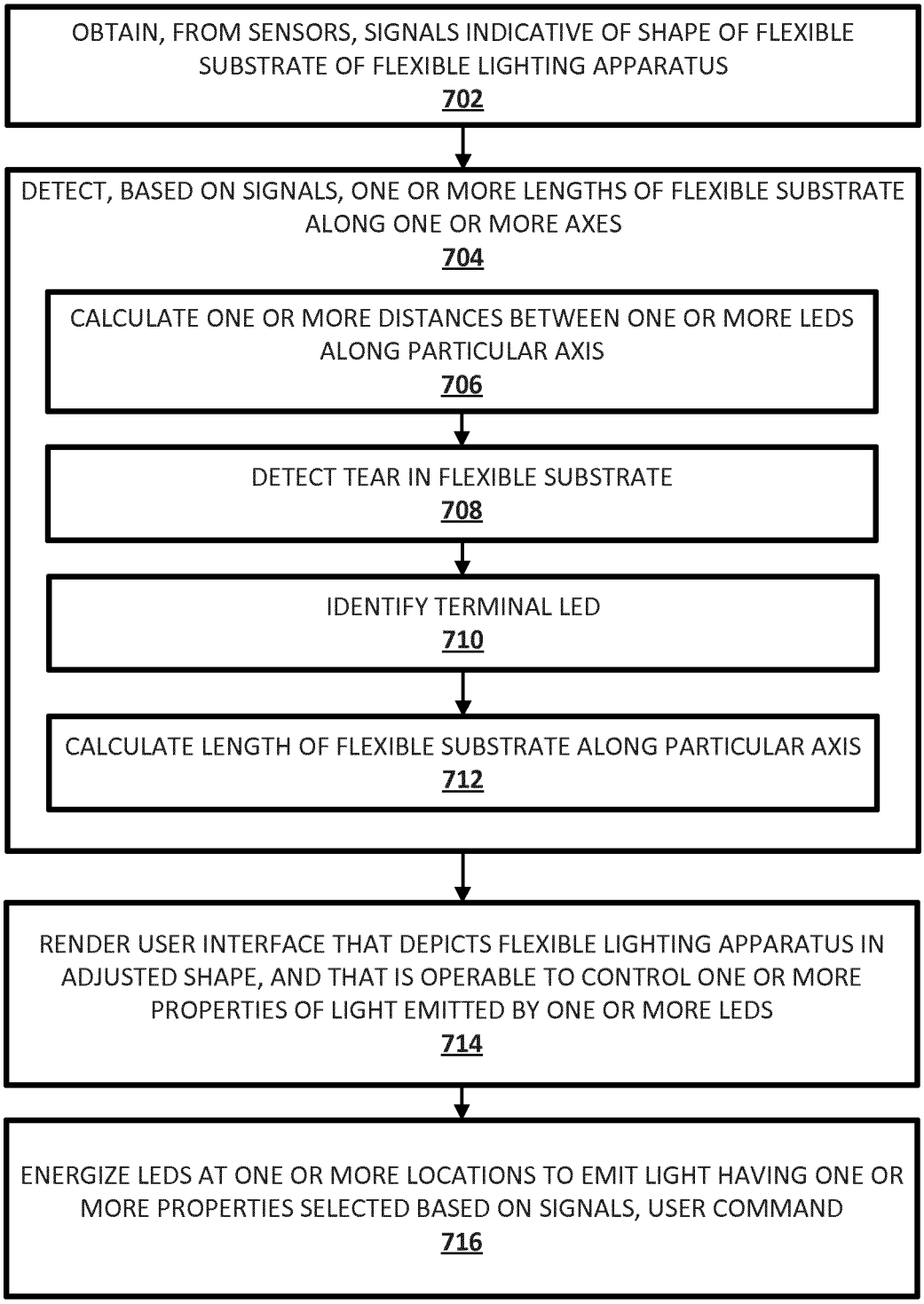
FIG. 7 depicts an example method, in accordance with various embodiments.

FIG. 7 depicts an example method 700 for lighting control, in accordance with various embodiments. At block 702, one or more signals may be obtained, e.g., by a controller (e.g., 106, 206, 306), from one or more sensors (e.g., 110, 210, 310). Those one or more signals may be indicative of a shape of a flexible substrate (e.g., 104, 204, 304, 504, 604) of a flexible lighting apparatus (e.g., 100, 200, 300, 500, 600).

At block 704, one or more lengths of the flexible substrate along one or more axes (in one, two or three dimensions) may be detected, e.g., by the controller, based on the one or more signals obtained from the sensors at block 702. Lengths of various types may be detected at block 704. For example, at block 706, one or more distances d between one or more neighboring LEDs (or nodes) along a particular axis may be calculated, e.g., based on a change in resistance using equation 1, above. At block 708, a tear may be detected, e.g., between two LEDs along a particular axis based on a sharp increase in resistance (e.g., approaching infinity) detected at a sensor at that location. At block 710, a terminal LED may be identified, e.g., immediately before the tear detected at block 708, using various techniques described above (e.g., polling). At block 712, one or more total lengths L of the flexible substrate along one or more axes may be calculated, e.g., based on a sum of distances d calculated at block 706 and/or a location of a tear detected at block 708.

At block 714, a user interface (e.g., 650) may be rendered, e.g., on a computing device (e.g., 654). The user interface may depict a flexible lighting apparatus in whatever shape it has been altered to (or its nominal shape if unaltered). The user interface may be operable to select one or more properties of light emitted by one or more LEDs of the flexible lighting apparatus. For instance, and as described above, a user may choose what type of gradient they'd like to render, as well as what the end values of the gradient should be.

At block 716, LEDs at one or more locations on the flexible substrate may be energized to emit light having one or more selected properties. Those properties may be selected based on the one or more signals from the sensors (or based on lengths determined based on the one or more signals), as well as based on user commands received at the user interface rendered at block 714.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An illumination system, comprising:

a flexible substrate;

a plurality of light-emitting diodes disposed along one or more axes of the flexible substrate;

a plurality of sensors configured to provide one or more signals indicative of a shape formed by the flexible substrate; and a controller communicably coupled with the plurality of LEDs and the plurality of sensors, the controller to:

detect one or more lengths of the flexible substrate along the one or more axes based on the one or more signals provided by the plurality of sensors; and energize one or more LEDs of the plurality of LEDs to emit light having one or more lighting properties selected based on the detected one or more lengths.

2. The illumination system of claim 1, wherein the controller is configured to detect that the flexible substrate has been stretched based on a change in resistance detected at one or more of the plurality of sensors.

3. The illumination system of claim 2, wherein the controller is further configured to calculate a distance between two or more of the plurality of LEDs based on the detected change in resistance, and to select the one or more lighting properties based on the calculated distance between the two or more of the plurality of LEDs.

4. The illumination system of claim 3, wherein the controller is further configured to select an intensity of light emitted by one or more of the two or more of the plurality of LEDs based on the calculated distance.

5. The illumination system of claim 1, wherein the plurality of sensors comprise a plurality of strain gauges.

6. The illumination system of claim 1, wherein the controller is configured to determine that the flexible substrate has been severed across an axis based on the one or more signals provided by the plurality of sensors.

7. The illumination system of claim 6, wherein the controller is configured to determine that the flexible substrate has been severed across the axis based on detection that a resistance associated with one or more sensors has increased above a predetermined threshold.

8. The illumination system of claim 1, wherein the plurality of LEDs and the plurality of sensors are spatially coextensive.

9. The illumination system of claim 8, wherein the controller is configured to identify a terminal LED along a particular axis of the flexible substrate based on the one or more signals provided by the plurality of sensors.

10. The illumination system of claim 9, wherein the controller is configured to identify the terminal LED along the particular axis of the flexible substrate based on an amount of current detected through one or more of a plurality of LEDs disposed along the particular axis.

11. The illumination system of claim 10, wherein the controller is configured to identify the terminal LED along the particular axis of the flexible substrate based on detected alteration of a control packet passed along one or more of the plurality of sensors or plurality of LEDs disposed along the particular axis.

12. A computer-implemented method, comprising:

obtaining, from a plurality of sensors associated with a flexible lighting apparatus, one or more signals indicative of a shape formed by a flexible substrate of the flexible lighting apparatus;

detecting, based on the one or more signals provided by the plurality of sensors, one or more lengths of the flexible substrate along one or more axes; and energizing one or more LEDs of a plurality of LEDs disposed along the one or more axes of the flexible substrate to emit light having one or more lighting properties selected based on the detected one or more lengths.

13. The computer-implemented method of claim 12, further comprising detecting that the flexible substrate has been stretched based on a change in resistance detected at one or more of the plurality of sensors.

14. The computer-implemented method of claim 12, further comprising detecting that the flexible substrate has been severed across an axis based on the one or more signals provided by the plurality of sensors.

15. A flexible lighting apparatus, comprising:

a flexible substrate;

a plurality of light-emitting diodes ("LEDs") disposed along one or more axes of the flexible substrate;

a plurality of sensors configured to provide one or more signals indicative of one or more distances between neighboring LEDs of the plurality of LEDs; and a controller communicably coupled with the plurality of LEDs and the plurality of sensors, the controller to energize one or more LEDs of the plurality of LEDs to emit light having an amount of a particular lighting property that is proportional to a distance between one or more neighboring LEDs.

* * * * *